US005643084A

United States Patent [19]

Mirsky

[11] Patent Number: 5,643,084

[45] Date of Patent: Jul. 1, 1997

[54] MOVING VIDEO JIGSAW PUZZLE

[75] Inventor: Richard M. Mirsky, Culver City, Calif.

[73] Assignee: Basic Software Limited Partnership 95, a Limited Partnership, Van Nuys, Calif.

[21] Appl. No.: 526,105

[22] Filed: Sep. 8, 1995

[51] Int. Cl.[6] ..... A63F 9/06; G09B 25/00

[52] U.S. Cl. ..... 463/9; 463/31; 463/35; 273/153 R; 273/156; 434/406; 434/323; 434/333; 434/307 R

[58] Field of Search ..... 273/153 R, 156, 273/157 R, 153 S; 463/1, 7, 9, 23, 30, 31, 36, 37, 35; 364/410, DIG. 2; 395/100, 118, 133, 152–155, 162, 164; 434/307 R, 406, 402, 323, 322, 333, 308, 318, 327

[56] References Cited

U.S. PATENT DOCUMENTS

| | | | |
|---|---|---|---|
| 4,219,194 | 8/1980 | Powers . | |
| 4,369,973 | 1/1983 | D'Aurora et al. . | |
| 4,625,969 | 12/1986 | Donnell . | |
| 4,863,172 | 9/1989 | Rosenwinkel et al. . | |
| 4,951,229 | 8/1990 | DiNicola et al. . | |
| 5,265,888 | 11/1993 | Yamamoto et al. . | |
| 5,296,845 | 3/1994 | Haller . | |
| 5,312,113 | 5/1994 | Ta-Hsien et al. . | |
| 5,362,054 | 11/1994 | Ashemimry . | |
| 5,368,301 | 11/1994 | Mitchell . | |
| 5,396,590 | 3/1995 | Kreegar . | |
| 5,404,437 | 4/1995 | Nguyen . | |
| 5,417,425 | 5/1995 | Blumberg et al. . | |
| 5,465,982 | 11/1995 | Rebane | 463/9 |
| 5,556,339 | 9/1996 | Cohen | 463/1 |
| 5,577,185 | 11/1996 | Tunnell et al. | 463/9 |

FOREIGN PATENT DOCUMENTS

2662009A1 5/1991 France .

OTHER PUBLICATIONS

Front and Back of Packaging for *Country Vid Grid*, 1995.
Front and Back of Packaging for *Kid Vid Grid*, 1994.
Front and Back of Packaging for *Vid grid*, 1994.

*Primary Examiner*—Jessica Harrison
*Assistant Examiner*—Mark A. Sager
*Attorney, Agent, or Firm*—David A. Farah; Sheldon & Mak, Inc.

[57] ABSTRACT

A computer-generated jigsaw puzzle game including a method of generating a jigsaw puzzle game on an electronic display and controlling the play of the game in response to play operations. The method includes the steps of displaying a jigsaw puzzle comprising a plurality of puzzle pieces on the electronic display, where each puzzle piece comprises a video image region on the display. A plurality of video image blocks is sequentially displayed in the video image region of each puzzle piece to generate a moving video image in the video image region of each puzzle piece. Pieces of the puzzle are moved on the display in response to play operations to solve the jigsaw puzzle. Also, a system for implementing the method of generating a jigsaw puzzle game on an electronic display and controlling the play of the game in response to play operations and a computer software system having a set of instructions for generating a jigsaw puzzle game on an electronic display and controlling the play of the game in response to operations.

47 Claims, 9 Drawing Sheets

MOVING VIDEO JIGSAW PUZZLE

NOTICE OF INCLUSION OF COPYRIGHTED MATERIAL

A portion of the disclosure of this patent document contains material which is subject to copyright protection. The copyright owner has no objection to the facsimile reproduction by any one of the patent disclosure. as it appears in the Patent and Trademark office patent files or records, but otherwise reserves all copyright rights whatsoever.

BACKGROUND

Jigsaw puzzles made of paper and other durable materials have entertained and educated puzzle players for decades. With the advent of personal computers, computer-generated pictorial jigsaw puzzles have also become popular among players of all ages.

In computer-generated pictorial jigsaw puzzles, a puzzle picture is electronically broken up into puzzle pieces and the puzzle pieces are scattered across an electronic viewing display. A player then manipulates the pieces on the display using a mouse or keyboard to connect interlocking puzzle pieces together until the puzzle picture is unscrambled.

While popular, existing computer-generated pictorial jigsaw puzzle pictures are static representations, that is non-moving images, similar to puzzle pictures made of durable material. As such, the computer-generated jigsaw puzzle image on each puzzle piece does not change while the game is being played. Further, existing computer-generated jigsaw puzzle games disadvantageously lack high quality sound effects, such as musical sequences, while the game is being played. Both non-static puzzle pieces and high quality sound effects would each provide feedback to the player, and significantly increase the level of excitement and interaction provided by the game.

There is, therefore, a need for a computer-generated jigsaw puzzle game which provides a player with moving video capability for increased entertainment, education, and interaction. Further, there is a need for a computer-generated jigsaw puzzle game which provides high quality sound effects while the game is being played.

SUMMARY

The present invention is directed to a computer-generated jigsaw puzzle game that satisfies these needs. In one embodiment, the present invention provides a method of generating a jigsaw puzzle game on an electronic display and controlling the play of the game in response to play operations. The method includes several steps. One step is displaying a jigsaw puzzle on the electronic display, where the jigsaw puzzle comprises a plurality of puzzle pieces positioned on the display and each puzzle piece comprises a video image region on the display. Another step is sequentially displaying a plurality of video image blocks in the video image region of each puzzle piece to generate a moving video image in the video image region of each puzzle piece. Still another step is moving pieces of the puzzle on the display in response to play operations to solve the jigsaw puzzle.

In a preferred embodiment, the step of displaying the jigsaw puzzle comprises the steps of receiving a frame of video image information, and then decomposing the frame into a plurality of blocks of video image information, where each block of video image information corresponds to a corresponding puzzle piece, respectively. The blocks of video image information are then sequentially displayed in the video image region of a corresponding puzzle piece to generate a moving video image. The above steps can be performed for a plurality of frames of video image information.

Preferably, moving one or more puzzle pieces in response to play operations includes snapping together two interlocking puzzle pieces when the interlocking pieces are placed proximate one another in response to play operations. As such, the snapped-together puzzle pieces form a single snapped puzzle piece which can be moved in response to play operations.

Preferably, displaying each puzzle piece includes excluding from the video image region of the puzzle piece any portion of the video image region which overlaps the video image region of another puzzle piece already displayed. As such, image flicker in overlapping puzzle pieces is eliminated.

In another embodiment, the present invention provides a method of generating audio signals in concert with the play of the game. Preferably, the audio signals are generated for a limited period of time in which a player is encouraged to solve the puzzle before the audio signals stop. The audio signals can be a sequence of musical tones.

In another embodiment, the present invention provides a system for implementing the method of generating a jigsaw puzzle game on an electronic display and controlling the play of the game in response to play operations.

In another embodiment, the present invention provides a computer software system having a set of instructions for generating a jigsaw puzzle game on an electronic display and controlling the play of the game in response to operations. The software system comprises a puzzle display process for displaying a jigsaw puzzle on the display, where the jigsaw puzzle is described above. The software system also includes a sequential display process for sequentially displaying a plurality of video image blocks in the video image region of the puzzle pieces to generate a moving video image in the video image region of the puzzle piece. The software system also includes a movement process for moving one or more puzzle pieces on the display in response to play operations to solve the jigsaw puzzle.

In a preferred embodiment, the sequential display process also includes a process for receiving frames of video image information, and a process for decomposing the frames of video image information into a plurality of blocks of video image information, where each block of video image information in a frame corresponds to a corresponding puzzle piece, respectively. The sequential display process can further include a process for sequentially displaying the blocks of video image information in the video image region of the corresponding puzzle piece.

The movement process includes 1) a set of instructions for detecting a play operation for moving a puzzle piece at a video image region at a first location on the display, 2) a set of instructions for determining the displacement of the puzzle piece from the first location on the display as directed by the play operation, 3) a set of instructions for displaying the puzzle piece in a video image region at a second location on the display offset from the first location by the displacement, and 4) a set of instructions for erasing that portion of the video image region at the first location on the display which is not overlapping with the video image region at the second location on the display.

In a preferred embodiment, the software system includes a set of instructions for snapping together two interlocking puzzle pieces when the interlocking puzzle pieces are placed proximate one another in response to play operations. The snapped-together puzzle pieces form a single snapped puzzle piece that is moved around in response to play operations.

The software system can also include a set of instructions for excluding from the video image region of each puzzle piece any portion of the video image region which overlaps the video image region of another puzzle piece already displayed. As such, image flicker in overlapping puzzle pieces is eliminated.

In another preferred embodiment, the software system includes a sound generation process for generating audio signals in concert with the play of the game. The audio signals can be played for a limited period of time in which a player of the game is encouraged to solve the puzzle before the audio signals stop. Preferably, the audio signals comprise a sequence of musical tones.

FIGURES

These and other features, aspects, and advantages of the present invention will become better understood with regard to the following description, appended claims, and accompanying drawing where:

DESCRIPTION

As disclosed herein, the present invention includes a method, an apparatus, and a computer software system for generating a jigsaw puzzle game on an electronic display and controlling the play of the game in response to play operations. While several specific embodiments of the present invention are disclosed herein, those skilled in the art will recognize that numerous other embodiments are possible as well.

Computer System Context

Figure 1:
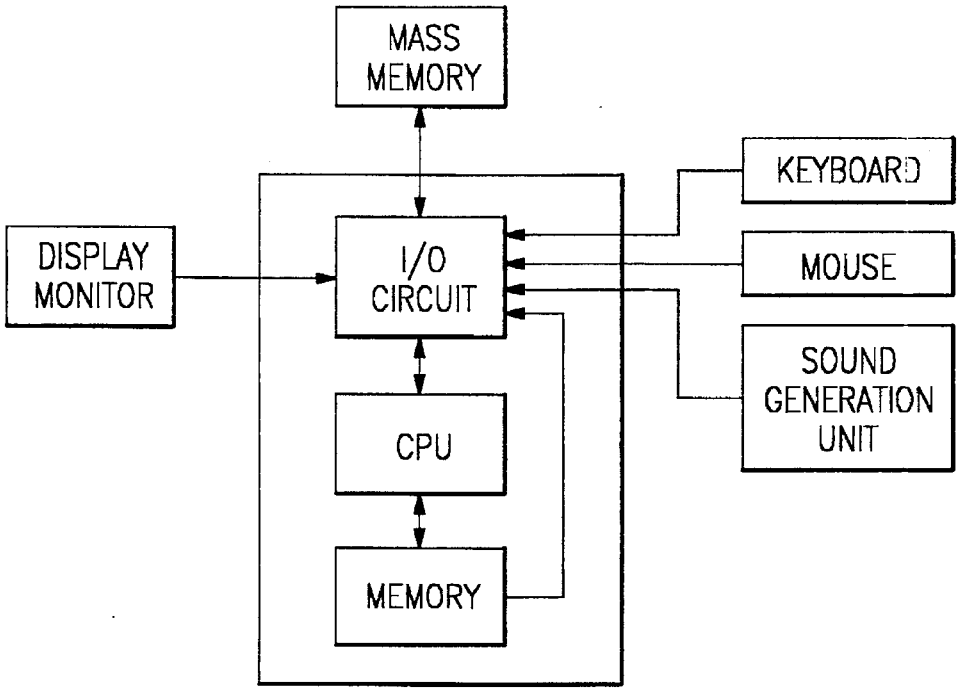
FIG. 1 illustrates a computer system as may be utilized with the present invention.

Referring now to FIG. 1, there is shown a typical computer-based system for generating a jigsaw puzzle game on an electronic display and controlling the play of the game in response to play operations according to one embodiment of the present invention. As illustrated, the system comprises a computer having 1) an input/output (I/O) for communicating information in appropriately structured form to and from other parts of the computer, 2) a central processing unit (CPU), and 3) memory. The CPU and the memory are representative of CPU and memory systems typically found in general purpose computers and almost all special purpose computers. One example of a suitable data processor for the computer system is a 586 personal computer, 60 MHz, with 8 MB RAM. As will be appreciated by those with skill in the art, multi-media systems can also be used which have at least substantially similar capabilities as the aforementioned computer system.

As shown in FIG. 1, the system also includes an electronic computer display monitor to display images generated by the present invention. Such electronic computer display monitors are well known to those with skill in the art.

The system further includes an input device, such as a mouse or a keyboard, coupled to the I/O circuit to allow a player to interact with the computer system by, for example, controlling a cursor displayed on the display monitor. As is understood by those with skill in the art, the input device can also be a track ball, joystick, light pen, voice activated input system, or other suitable input unit input device.

Further, a mass memory unit is coupled to the I/O circuit to provide additional storage capabilities to the computer. The mass memory unit can be used to retain data such as video images, sound, and other data. The data retained within the mass memory unit can be incorporated in standard fashion into the computer system as part of the memory unit. Optionally, the mass memory unit can be an optical disk drive such as a CD-ROM drive, a magnetic disk drive, or suitable storage device.

As further shown in FIG. 1, the invention includes a sound generation unit attached to the I/O circuit to generate high quality sound effects. The sound generation unit can be sound card such as an 8-bit digital sound system or any other compatible sound generation unit as will be understood by those with skill in the art with reference to the disclosure herein.

According to one preferred embodiment of the invention, the system is implemented using a 586 personal computer, 60 MHz, Windows 3.1 or later, 8 MB RAM, double speed CD-ROM drive, mouse, 8-Bit digital sound or Soundblaster compatible, 640×480 pixel resolution super VGA video card capable of displaying 256 colors.

Details of the Present Invention

Figure 2:
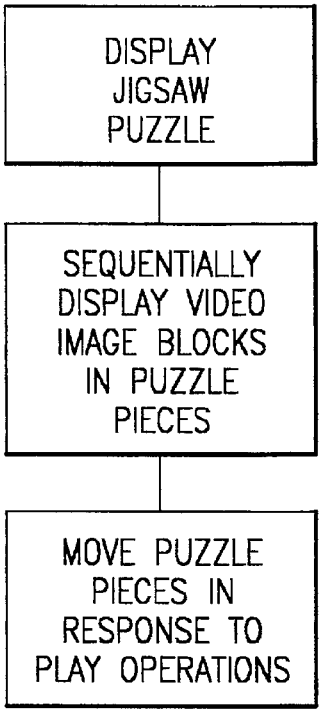
FIG. 2 is a block diagram of the steps of an embodiment of the method of the present invention.

Referring now to FIG. 2, there is shown a method of generating a jigsaw puzzle game on an electronic display and controlling the play of the game in response to play operations, according to one embodiment of the present invention. The method includes several steps. One step is displaying a jigsaw puzzle on a display. The jigsaw puzzle comprises a plurality of puzzle pieces positioned on the display and each puzzle piece comprises a video image region on the display. Another step is sequentially displaying a plurality of video image blocks in the video image region of at least one puzzle piece to generate a moving video image in the video image region of the puzzle piece. Still another step is moving one or more puzzle pieces on the display in response to play operations to solve the jigsaw puzzle. These steps can be performed simultaneously or in several different sequences as will be understood by those with skill in the art with reference to the disclosure herein.

Figure 3:
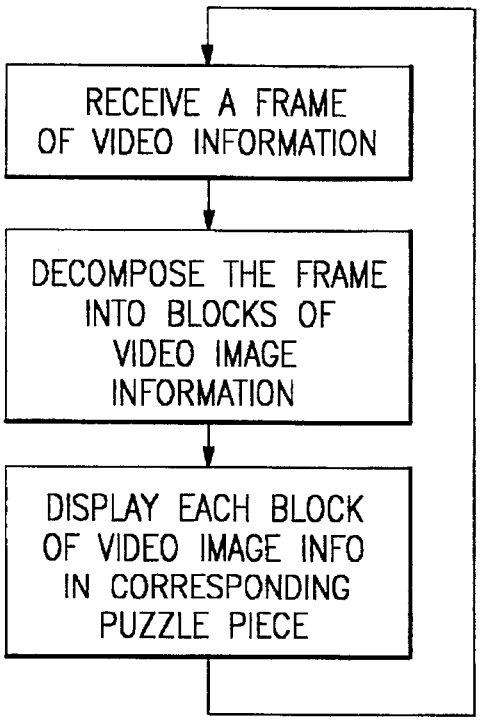
FIG. 3 is a block diagram of the display steps of the method of FIG. 2.

Referring to FIG. 3, the puzzle is displayed by repetitively 1) receiving a frame of video image information, 2) decomposing the frame of video image information into a plurality of blocks of video image information, wherein each block of video image information corresponds to a corresponding puzzle piece, respectively, and 3) displaying each block of video image information in the video image region of the corresponding puzzle piece. These steps can be performed simultaneously or in several different sequences as will be understood by those with skill in the art with reference to the disclosure herein. The step of sequentially displaying a plurality of video image blocks comprises performing steps 1) through 3) for a plurality of frames of video image information. Steps 1) through 3) are preferably repeated at a rate of at least 12 per second though other rates such as 15 per second or 30 per second are also suitable.

In a preferred embodiment, the step of sequentially displaying video image blocks comprises sequentially displaying a plurality of video image blocks in the video image region of each puzzle piece to generate a moving video image in the video image region of each puzzle piece. In another preferred embodiment, displaying each puzzle piece further comprises excluding from the video image region of the puzzle piece any portion of the video image region which overlaps the video image region of another puzzle piece already displayed in order to eliminate image flicker in overlapping puzzle pieces.

The step of receiving a frame of video image information can further comprise receiving a compressed frame of video image information, and decompressing the compressed frame to generate a frame of video image information.

Figure 4:
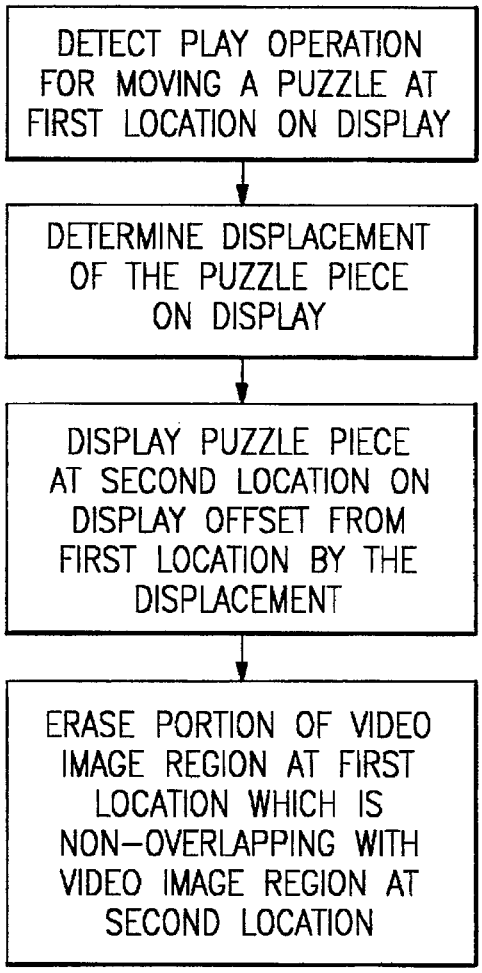
FIG. 4 is a block diagram of the movement steps of the method of FIG. 2.

As shown in FIG. 4, moving one or more puzzle pieces on the display comprises several steps. One step is detecting a play operation for moving a puzzle piece at a video image region at a first location on the display. Another step is determining the displacement of the puzzle piece from the first location on the display as directed by the play operation. Still another step is displaying the puzzle piece in a video image region at a second location on the display offset from the first location by the displacement. Another step is erasing that portion of the video image region at the first location on the display which is not overlapping with the video image region at the second location on the display.

Preferably, moving one or more puzzle pieces further comprises snapping together two interlocking puzzle pieces when the interlocking puzzle pieces are placed proximate one another in response to the play operations. As such, the snapped-together puzzle pieces form one single snapped puzzle piece which solves the jigsaw puzzle. Then, the snapped puzzle pieces can be moved in response to play operations.

In one preferred embodiment, the present invention provides a method for generating audio signals in concert with the play of the jigsaw puzzle. Preferably, the audio signals comprise a sequence of musical tones. More preferably, the audio signals are generated for a preselected period of time so that a player of the game is encouraged to solve the puzzle before the audio signals stop.

In another embodiment, the present invention provides a computer software system having a set of instructions for generating a jigsaw puzzle game on an electronic display and controlling the play of the game in response to play operations. The software system comprises a puzzle display process for displaying a jigsaw puzzle on the display, where the jigsaw puzzle comprises a plurality of puzzle pieces positioned on the display, and where each puzzle piece comprises a video image region on the display. The software system includes a sequential display process for sequentially displaying a plurality of video image blocks in the video image region of at least one puzzle piece to generate a moving video image in the video image region of the puzzle piece. The software system also includes a movement process for moving one or more puzzle pieces on the display in response to play operations to solve the jigsaw puzzle.

Preferably, the sequential display process further comprises 1) a subprocess for receiving frames of video image information, 2) a subprocess for decomposing each frame of video image information into a plurality of blocks of video image information, wherein each block of video image information in a frame corresponds to a corresponding puzzle piece, respectively, and 3) a subprocess for sequentially displaying the blocks of video image information in the video image region of the corresponding puzzle piece. Preferably, the three subprocesses of the sequential display process execute in the sequence listed above for a sequence of frames of video information.

Preferably, the receiving process comprises a set of instructions for receiving a compressed frame of video image information, and decompressing the compressed frame to generate a frame of video image information. Generally, video information is compressed to save storage space and then decompressed for display. The compression and decompression is performed by codec processes and systems well known to the those with skill in the art.

To generate moving video in all the puzzle pieces, the sequential display process can further comprise a set of instructions for sequentially displaying a plurality of video image blocks in the video image region of each puzzle piece to generate a moving video image in the video image region of each puzzle piece.

The movement process preferably comprises 1) a set of instructions for detecting a play operation for moving a puzzle piece at a video image region at a first location on the display, 2) a set of instructions for determining the displacement of movement of the puzzle piece from the first location on the display as directed by the play operation, 3) a set of instructions for displaying the puzzle piece in a video image region at a second location on the display offset from the first location by the displacement of movement, and 4) a set of instructions for erasing that portion of the video image region at the first location on the display which is non-overlapping with the video image region at the second location on the display. The movement process can further comprise a set of instructions for moving one or more snapped puzzle pieces in response to play operations.

In a preferred embodiment, the software system further comprises a set of instructions for snapping together two interlocking puzzle pieces when the interlocking puzzle pieces are placed proximate one another in response to play operations. The jigsaw puzzle is solved when all interlocking puzzle pieces are snapped together to form a single snapped puzzle piece.

The puzzle display process can further comprise a set of instructions for excluding from the video image region of each puzzle piece any portion of the video image region which overlaps the video image region of another puzzle piece already displayed in order to eliminate image flicker in overlapping puzzle pieces.

The software system further comprises a sound generation process for generating audio signals in concert with the play of the game. Preferably, the audio signals comprise a sequence of musical tones. The sound generation process can comprise a set of instructions for generating the audio signals for a preselected period of time so that a player of the game is encouraged to solve the puzzle before the audio signals stop.

In another embodiment, the present invention is a system for generating a jigsaw puzzle game on an electronic display and controlling the play of the game in response to play operations. The system comprises display means for displaying a jigsaw puzzle on the display, where the jigsaw puzzle comprises a plurality of puzzle pieces positioned on the display, and each puzzle piece comprises a video image region on the display. The display means preferably includes, 1) means for receiving frames of video image information, 2) means for decomposing the frames of video image information into a plurality of blocks of video image information, wherein each block of video image information in a frame corresponds to a corresponding puzzle piece, respectively, and 3) means for sequentially displaying the blocks of video image information in the video image region of a corresponding puzzle piece to generate a moving video image in the video image region of each puzzle piece. The puzzle display means can further comprise means for excluding from the video image region of each puzzle piece any portion of the video image region which overlaps the video image region of another puzzle piece already displayed in order to eliminate image flicker in overlapping puzzle pieces.

The system further includes means for moving one or more puzzle pieces on the display in response to play operations to solve the jigsaw puzzle. The means for moving puzzle pieces preferably includes, 1) means for detecting a play operation for moving a puzzle piece at a video image region at a first location on the display, 2) means for determining the displacement of movement of the puzzle piece from the first location on the display as directed by the play operation, 3) means for displaying the puzzle piece in a video image region at a second location on the display offset from the first location by the displacement of movement, and 4) means for erasing that portion of the video image region at the first location on the display which is non-overlapping with the video image region at the second location on the display.

Preferably, the means for moving puzzle pieces comprises means for snapping together two interlocking puzzle pieces when the interlocking puzzle pieces are placed proximate one another in response to play operations. As such, the snapped-together puzzle pieces form one single snapped puzzle piece which solves the jigsaw puzzle. The means for moving puzzle pieces can further comprise means for moving one or more snapped puzzle pieces in response to play operations.

The system can further comprise sound generation means for generating audio signals in concert with the play of the game. Preferably, the audio signals comprise a sequence of musical tones. The sound generation means can further comprise means for generating the audio signals for a period of time whereby a player of the game is encouraged to solve the puzzle before the audio signals stop.

The system according to the present invention can be a general purpose computer system as described herein programmed with a set of computer instructions to generate a jigsaw puzzle game on a computer monitor and control the play of the game in response to play operations according to the present invention. The system according to the present invention can also be a dedicated computer system with input devices, as described hereinabove, programmed to generate a jigsaw puzzle game on a display monitor according to the present invention. As is well known to those with skill in the art, such dedicated systems commonly include electronic board games. Therefore, the display means, the movement means, the snapping means, the excluding means, and the sound generating means described hereinabove can comprise the aforementioned programmed general purpose or dedicated computer systems.

The programmed instructions can be in any programming language as will be understood by those with skill in the art with reference to the disclosure herein, and can be in the form of computer instructions in computer RAM or ROM memory or in the form of firmware. The frames of video information can be stored in the computer memory or received from an external mass storage device such as a CD-ROM drive as disclosed above.

The sound generation means can be a digital sound system, or a sound card including software as part of the computer system disclosed herein or coupled to the computer system. The audio information is in the same file as the video information. Audio playback is done automatically by Video for Windows™.

EXAMPLE

An illustrative example of an embodiment of the present invention will now be described. The computer software system of the present invention can be implemented on a computer system such as described above and utilizing a graphics package. Ideally, graphics applications that run on computer systems utilize the system's underlying graphics engine to promote consistency from one application to another. Typically, graphics applications provide a user with a window (also called a visible display area) in which to manipulate a graphics object such as a puzzle piece image region.

An example of such a graphics package utilized by the software system of the present invention is the Windows™ windowing system from Microsoft, Inc.SM The Windows Application Programming Interface (API) is described in Microsoft Windows Software Development Kit Programmer's Reference©, which is incorporated in its entirety herein by reference. Although the Windows system includes a graphics engine for displaying graphics objects on a display screen, one embodiment of the present invention utilizes Video for Windows™ to incorporate video and sound processing into Windows-based applications. Video for Windows is described in Microsoft Video For Windows Development Kit Programmer's Guide©, which is incorporated in its entirely herein by reference.

Operation Overview

An overview of the operation of the example embodiment of a system according to the present invention is now provided. When the system begins operation, a player is presented with an electronically generated jigsaw puzzle as described above. To provide moving video in each of the puzzle pieces, a frame of video information is read from a CD-ROM drive and stored in memory. The frame is subdivided into blocks of video information where each block corresponds to a corresponding puzzle piece. The image in each block is then displayed in the corresponding puzzle piece. Musical tones are also read from the CD-ROM and generated in concert with display of the puzzle pieces. The entire process is repeated for each frame of video information read from the CD-ROM.

Operation Details

A process utilizing Video for Windows reads a frame of the video image data off the CD-ROM and decompresses it into the computer system memory via a codec.

A puzzle data file is utilized to create the puzzle pieces. In a preferred embodiment, there are 16 puzzle pieces which can be increased to at least 36 puzzle pieces depending on computer system speed. The puzzle data file includes, 1) a set of points describing the outline of the puzzle pieces, 2) the coordinates of each puzzle piece within the video frame, 3) the maximum width and height of each puzzle piece, 4) the interlock coordinates of the puzzle pieces, and 5) any special traits of each puzzle piece.

The decompressed video image frame is a continuous set of data which can be represented as a rectangle representing a video image. Each piece of the assembled puzzle lays over the top of the rectangle of video image data at a certain location as defined by the puzzle data file. For example, the first puzzle piece would map to coordinates 0, 0 within the rectangle, and, the next piece can map to coordinate 5, 5, going left to right, and so forth.

A set of video image regions on the display representing the outline of the puzzle pieces on the display as defined by the data file is created. Each video image region is a Windows-type region. To create a Windows-type region, a Windows API call ("CreatePolygonRgn") is performed with a pointer to a set of points defining the region outline and the number of points. The region is a Windows' internally-defined region. The region then becomes a clipping region by selecting the region as the clipping region for a window utilizing a Windows API call. A clip region is the area defined by the set of points within which drawing takes place. Any image drawn into the region is clipped to that region.

Each puzzle piece corresponds to a rectangular block in the image. The width and height of the rectangular block is substantially the same as the maximum width and maximum height of a corresponding puzzle piece. As such, the puzzle piece shape would fit inside the rectangular block. A puzzle piece can be drawn on the screen utilizing the block dimensions, the address of the memory containing the entire video image, and the coordinates of each puzzle piece in the image. The drawing can begin at a certain coordinate offset into that image, with the width and height of the block dimension to be drawn, and the location on the screen to draw.

Before drawing or displaying each puzzle piece, the clipping region defining the outline of the puzzle piece on the display is selected as described above. The maximum width and maximum height of each clipping region are the same as the height and width of the corresponding rectangular block described above.

For each puzzle piece, a Video For Windows API call draws the image within the corresponding rectangular piece into the clipping region of the video region of the puzzle piece on the display. The parameters to the API call include the memory address of the entire video frame, the offset into the memory to start (that is, the coordinates of the puzzle piece rectangular block within the source image), and the coordinates of the destination (that is, the location of drawing on the actual screen). Drawing is performed within the clipping region of the puzzle piece only. Each piece is redrawn as described above for every new frame of video information.

Figure 5:
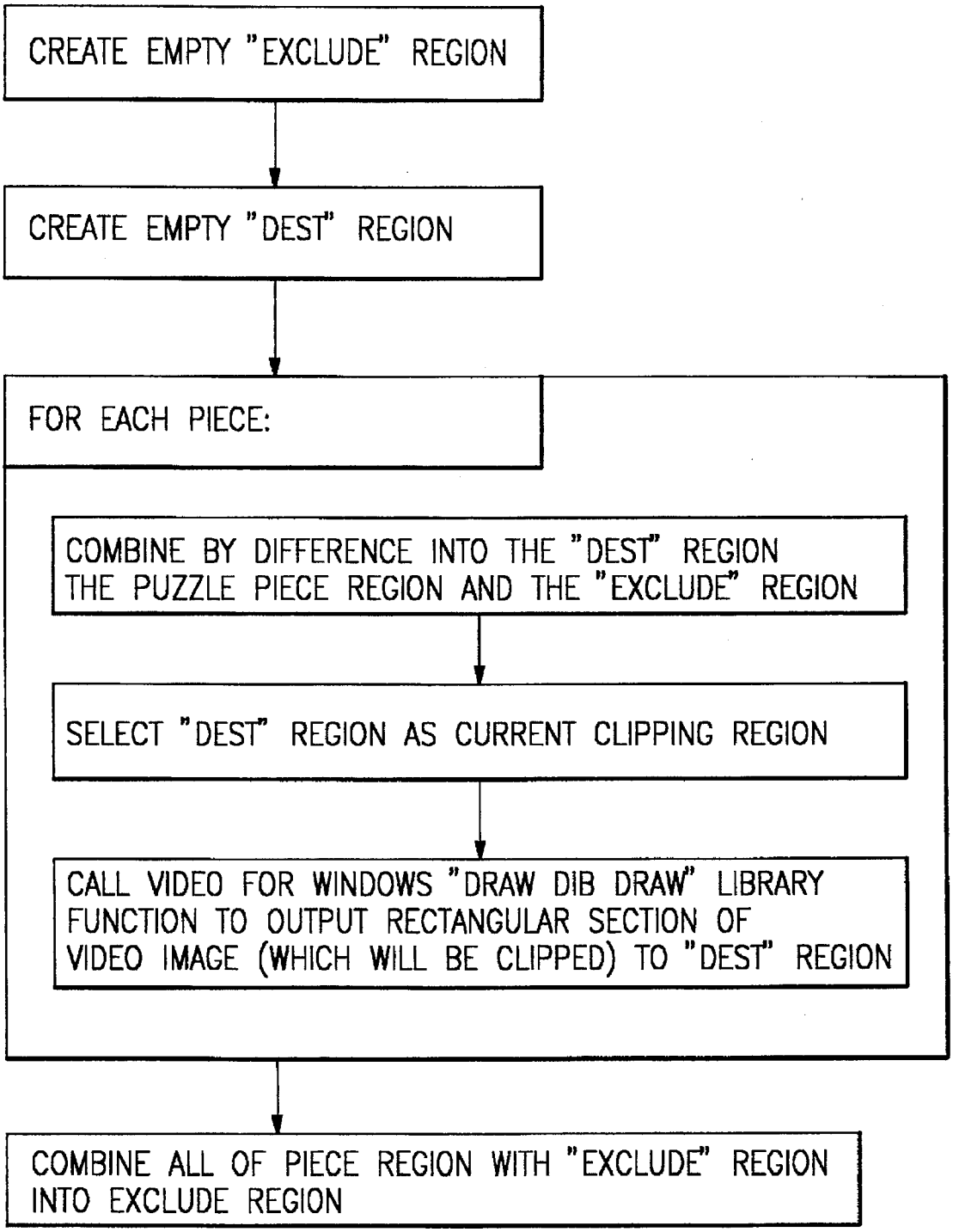
FIG. 5 is pseudo code of the exclusion method of the display steps of the present invention.

When pieces of the puzzle are drawn on top of one another, the pieces appear to flicker because every piece is redrawn at every frame. It appears visually to the player that a part of the piece is being erased, and then redrawn. Therefore, it is desirable to eliminate that part of the region that is common to both pieces. As such only the part of the puzzle piece that does not overlap an already drawn puzzle piece is drawn. Referring now to FIG. 5, a pseudo code segment implementing this method is depicted.

To snap interlocking puzzle pieces as described above, each puzzle piece has a snap list, and a snap list number associated with it. When two interlocking puzzle pieces, as defined by the puzzle data file, are snapped together, the snap list of one puzzle piece is copied to the snap list the other, and the snap list number of the puzzle pieces being snapped is changed. Further, a list of snapped-together puzzle pieces is maintained to allow collective movement of a snapped-together set of puzzle pieces.

Figure 6:
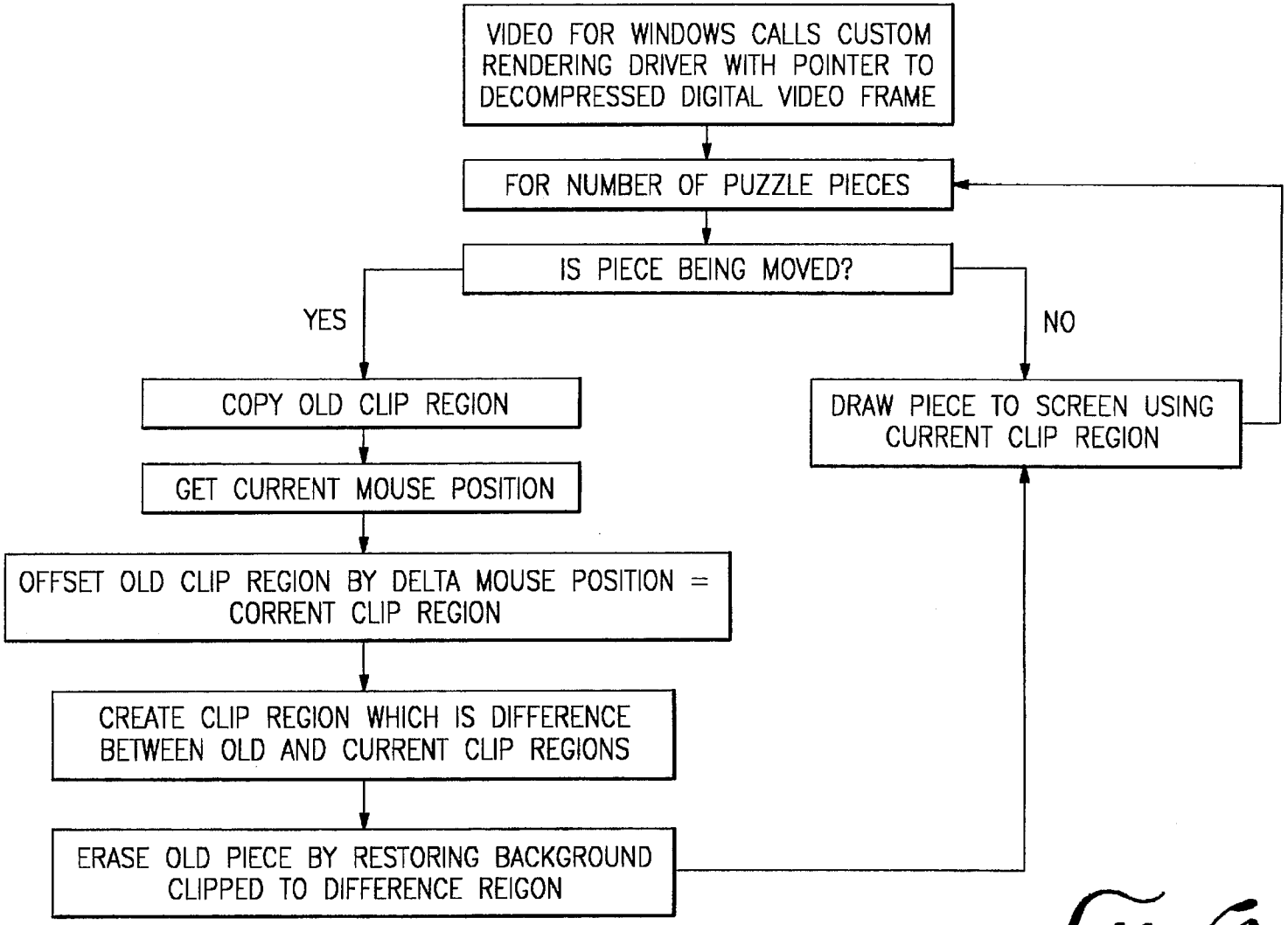
FIG. 6 is a flowchart of the process for moving a puzzle piece according to the present invention.

A puzzle piece is moved on the display when a player drags the puzzle piece with a mouse. The puzzle piece is moved by the amount of mouse movement. Referring to FIG. 6, the old clipping region of the puzzle piece is copied and a new clipping region is created by offsetting the old clipping region by the amount of mouse movement. An "erase" clipping region is created from the difference of the new and the old clipping regions. The "erase" clipping region is used to erase the portion of the screen that is in the old clipping region and is not in the new clipping region. The "erase" region is discarded along with the initial clipping region. The new region is then used to draw the puzzle piece. A Windows API call ("combine region") provides a region that consists of every part of a first region that is not in a second region.

Further, when a puzzle piece is moved over another puzzle piece, the clipping region of the bottom puzzle piece is temporarily modified to exclude the overlap, and thereby minimize the amount of drawing. If the piece is snapped to an interlocking piece, a new region is created to outline the snapped pieces. In general, a puzzle piece can be moved anywhere on the physical display without being bound to Windows' window boundary limitation.

The above example embodiment can be implemented as a computer system software or as a programmed computer system or electronic board game as described above. The instructions for the example embodiment of the computer software system of the present invention is appended as Appendix A in a computer program.

Figure 7:
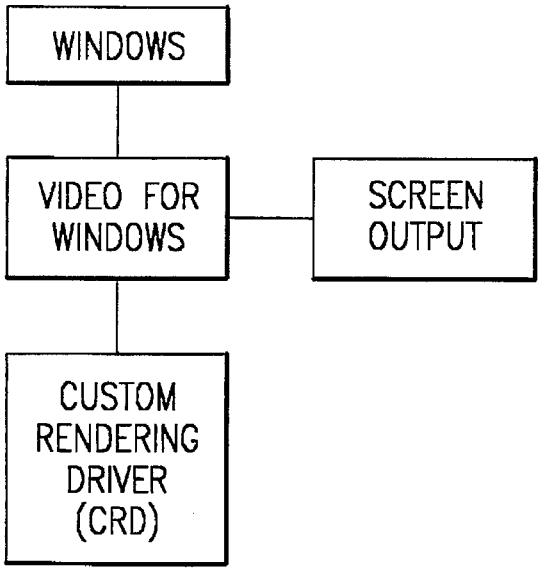
FIG. 7 is a block diagram of the embodiment of the software system of the present invention shown in Appendix A.
Figure 8:
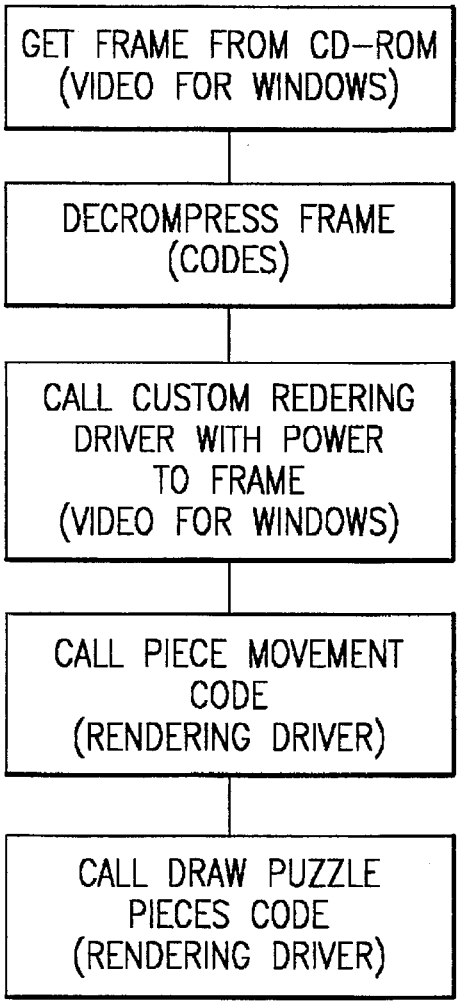
FIG. 8 is a flow chart of the overall process of the embodiment of the software system of the present invention as shown in Appendix A.
Figure 9A:
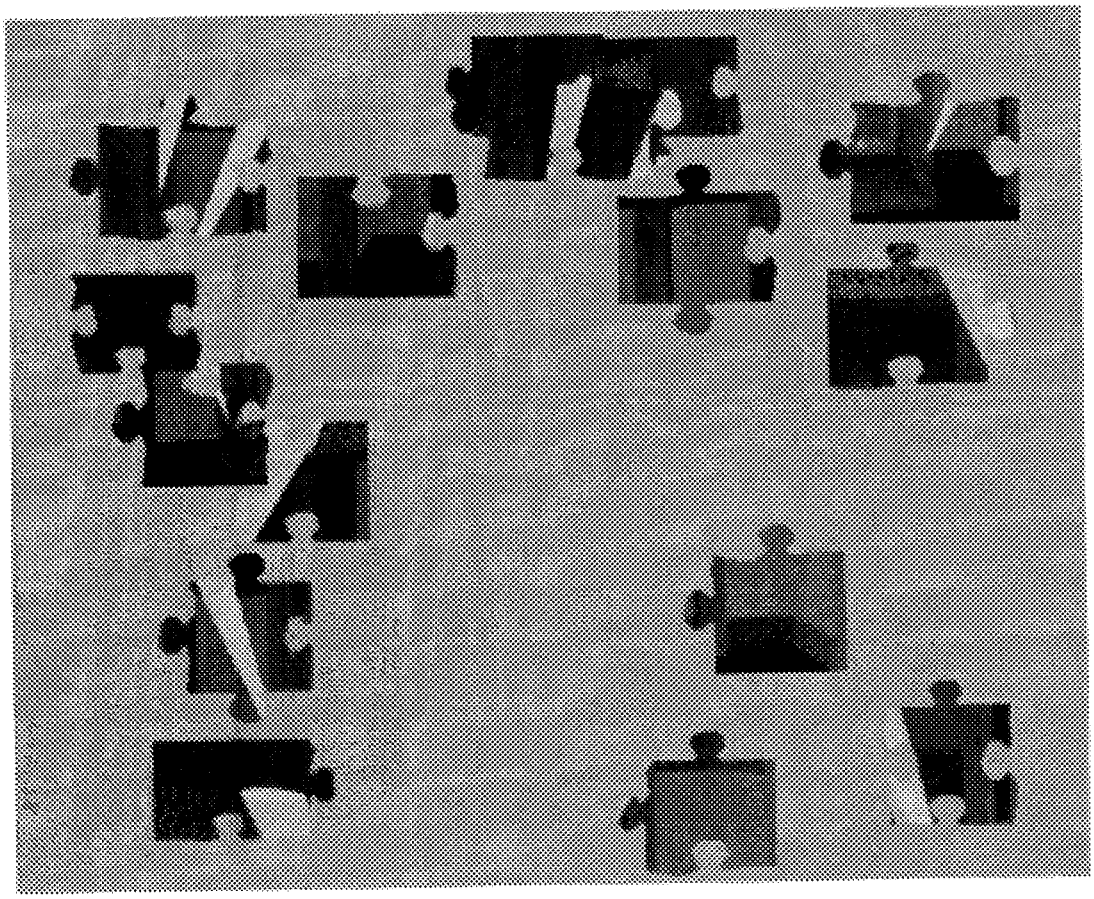
FIGS. 9(*a*)–(*d*) are a sequence of screen snapshots of a jigsaw puzzle game in progress according to the present invention.
Figure 9B:
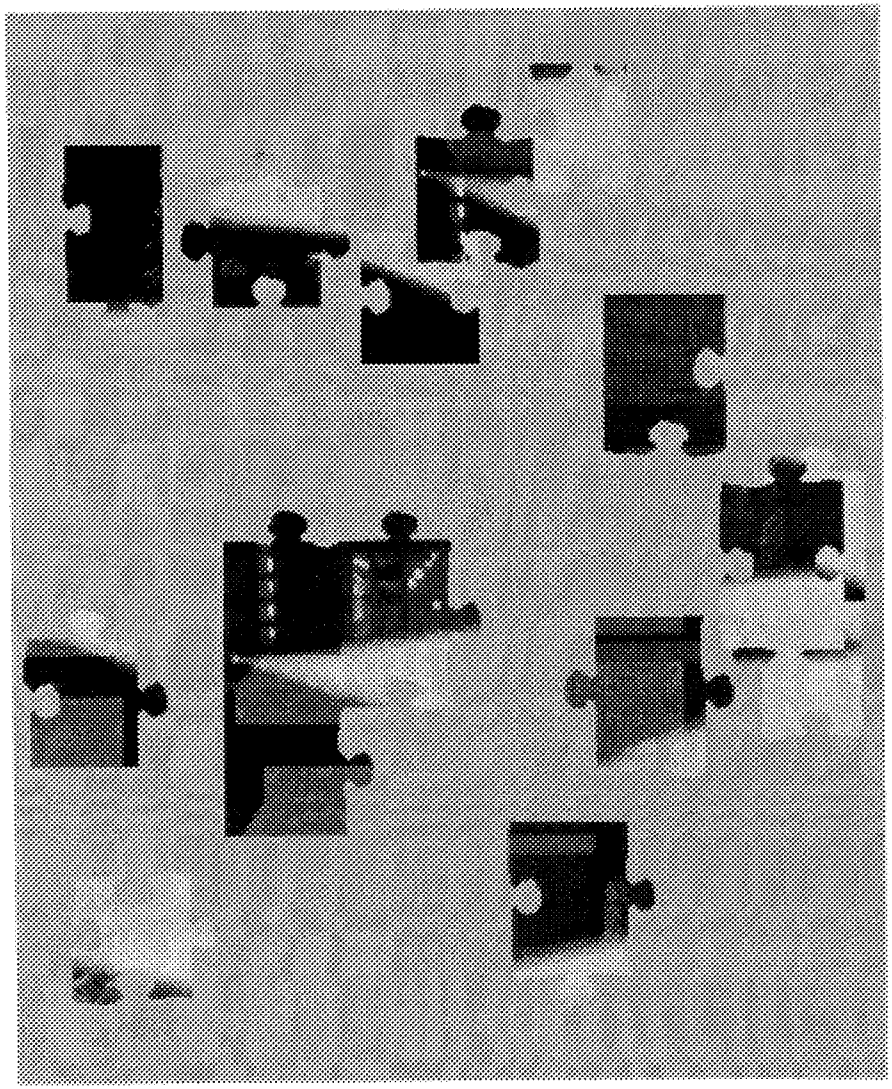
Figure 9C:
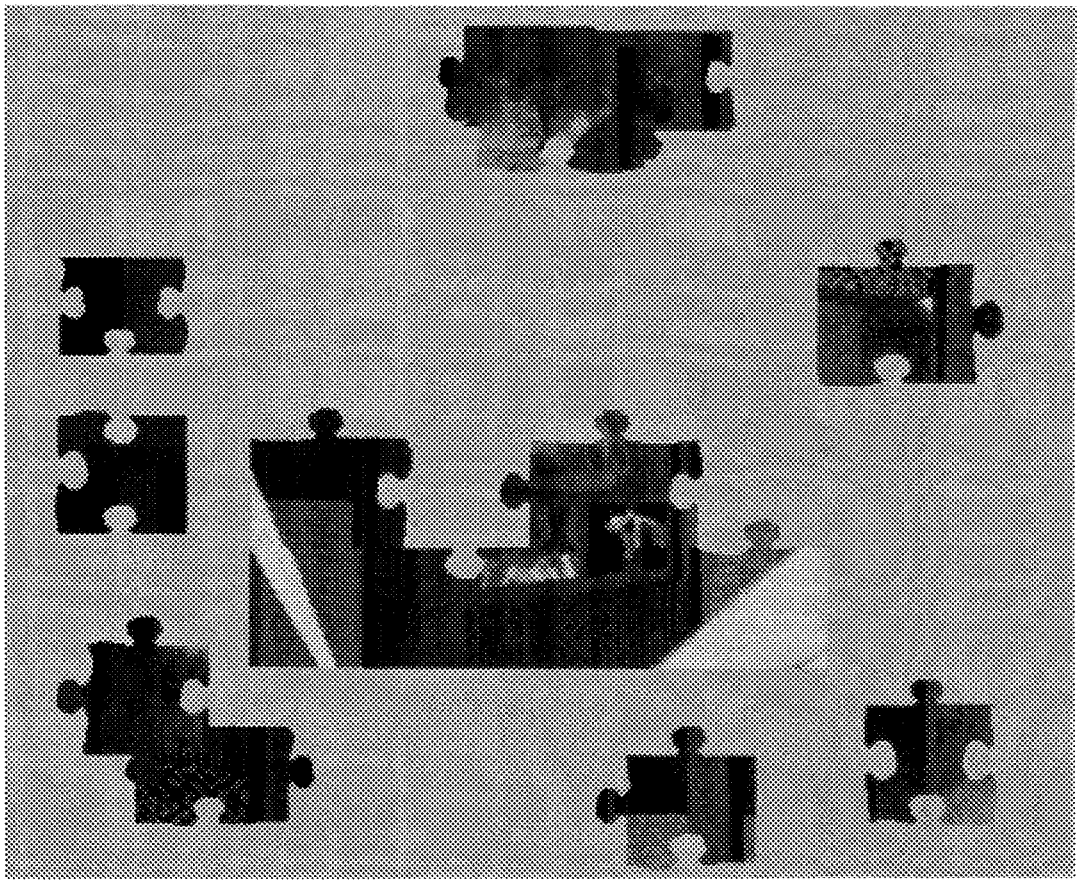
Figure 9D:
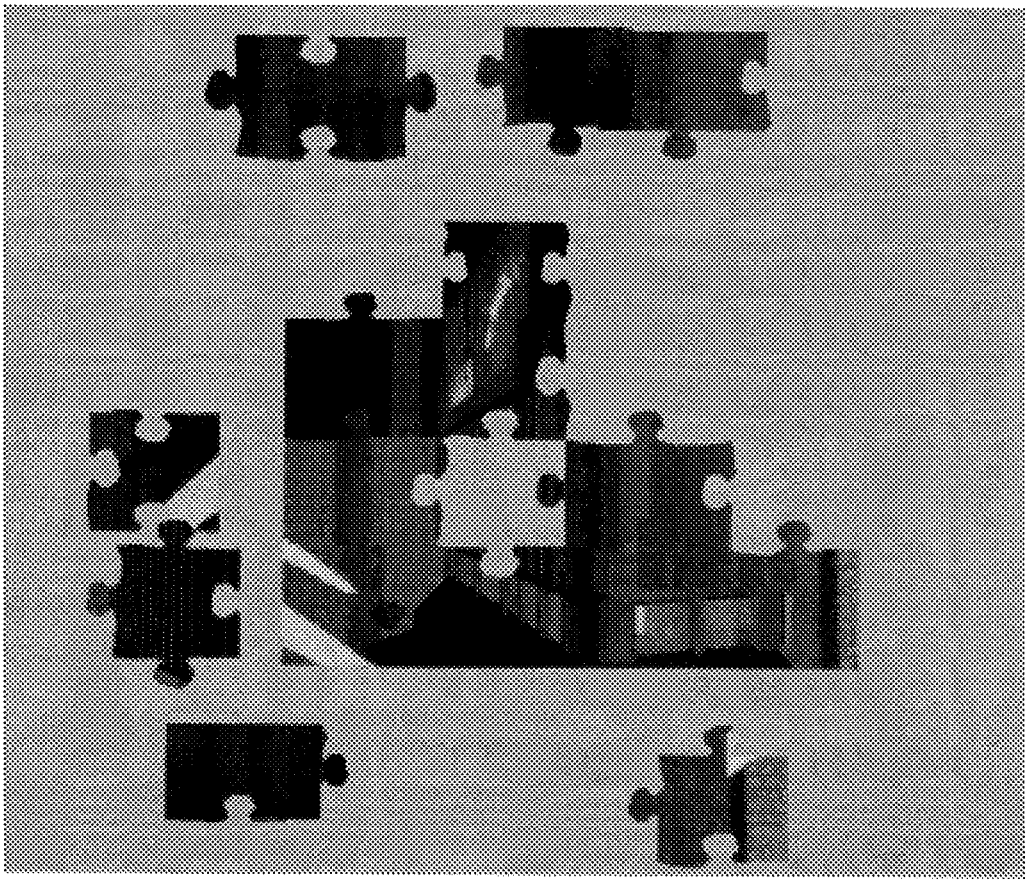

FIG. 7 shows a block diagram of the interrelationship of the primary components of the software system of Appendix A. FIG. 8 shows a flowchart for the overall processes of listing of Appendix A. The Custom Rendering Driver (CRD) is registered with Video for Windows as the process responsible for drawing the puzzle pieces. Therefore, when a video frame is ready to be drawn to the screen, a Video for Windows call invokes the CRD. The CRD in turn calls a drawing process.

Video for Windows will not call the draw process until the drawing is completed. The drawing process is executed in enough time to be ready for the next frame. If the drawing is not complete when the next frame arrives, Video for Windows can skip a frame until the drawing is completed. When a puzzle piece is being moved, the process of decompressing the video frame continues, even though there may me a delay in decompression.

Referring to FIGS. 9(*a*)–(*d*), a sequence of screen snapshots of a jigsaw puzzle game in progress according to the present invention is shown. The sequence shows moving video images in the puzzle pieces, and interlocking puzzle pieces being snapped together.

Utilizing the method, system and software system disclosed herein, a player of the electronically generated jigsaw puzzle is provided with an unprecedented level of excitement and entertainment in solving the puzzle because the player must not only find interlocking pieces of the puzzle but must also unscramble a moving video sequence.

Although the present invention has been described with reference to certain preferred embodiments, many other embodiments will be apparent to those with skill in the art. For example, the electronically generated jigsaw puzzle can be in full color, limited color or greyscale. Further, the video frame in memory can be 320×240 pixels or can be other suitable frame sizes. Therefore, the spirit and scope of the appended claims should not be limited to the description of the preferred versions contained herein.

What is claimed is:

1. A method of generating a game which is a jigsaw puzzle game on a display and controlling play of the game in response to play operations, the method comprising the steps of:

(a) displaying the jigsaw puzzle game on the display, the game comprising a plurality of puzzle pieces positioned on the display, wherein each puzzle piece comprises a video image region on the display;

(b) sequentially displaying a plurality of video image blocks in the video image region of at least one puzzle piece to generate a moving video image in the video image region of the puzzle piece; and (c) moving one or more puzzle pieces on the display in response to play operations to solve the game; and wherein the step of displaying each puzzle piece further comprises the step of excluding from the video image region of the puzzle piece any portion of the video image region which overlaps the video image region of another puzzle piece already displayed, whereby image flicker in overlapping puzzle pieces is eliminated.

2. The method of claim 1 wherein the step of displaying the jigsaw puzzle game further comprises the steps of:

(i) receiving a frame of video image information;

(ii) decomposing the frame of video image information into a plurality of blocks of video image information, wherein each block of video image information corresponds to a corresponding puzzle piece, respectively; and (iii) displaying each block of video image information in the video image region of the corresponding puzzle piece.

3. The method of claim 2 wherein the step of sequentially displaying a plurality of video image blocks comprises performing steps (i)–(iii) for a plurality of frames of video image information.

4. The method of claim 3 wherein steps (i)–(iii) are performed once per frame at a rate of at least 12 per second.

5. The method of claim 3 wherein the step of receiving a frame of video image information comprises the steps of:

(i) receiving a compressed frame of video image information; and (ii) decompressing the compressed frame to generate a frame of video image information.

6. The method of claim 1 wherein the step of sequentially displaying video image blocks comprises sequentially displaying a plurality of video image blocks in the video image region of each puzzle piece to generate a moving video image in the video image region of each puzzle piece.

7. The method of claim 1 wherein the step of moving one or more puzzle pieces on the display comprises the steps of:

(a) detecting a play operation for moving a puzzle piece at a video image region at a first location on the display;

(b) determining a displacement of the puzzle piece from the first location on the display as directed by the play operation;

(c) displaying the puzzle piece in a video image region at a second location on the display offset from the first location by the displacement; and (d) erasing that portion of the video image region at the first location on the display which is non-overlapping with the video image region at the second location on the display.

8. The method of claim 1 wherein the step of moving one or more puzzle pieces in response to play operations further comprises the step of snapping together two interlocking puzzle pieces when the interlocking puzzle pieces are placed proximate one another in response to the play operations, wherein the snapped together puzzle pieces form a single snapped puzzle piece to solve the game.

9. The method of claim 8 wherein the step of moving one or more puzzle pieces further comprises the step of moving one or more snapped puzzle pieces in response to play operations.

10. The method of claim 1 further comprising the step of generating audio signals in concert with the play of the game.

11. The method of claim 10 wherein the audio signals comprise a sequence of musical tones.

12. The method of claim 10 wherein the step of generating the audio signals comprises generating the audio signals for a period of time whereby a player of the game is encouraged to solve the puzzle before the audio signals stop.

13. A method of generating a game which is a jigsaw puzzle game on a display and controlling play of the game in response to play operations, the method comprising the steps of:

(a) displaying the jigsaw puzzle game on the display, the game comprising a plurality of puzzle pieces positioned on the display, and each puzzle piece comprising a video image region on the display, wherein displaying the game comprises repeating the steps of:

(i) receiving a compressed frame of video image information and decompressing the compressed frame to generate a frame of video image information;

(ii) decomposing the frame of video image information into a plurality of blocks of video image information, wherein each block of video image information corresponds to a corresponding puzzle piece, respectively; and (iii) displaying each block of video image information in the video image region of the corresponding puzzle piece;

(b) moving one or more puzzle pieces on the display in response to play operations to solve the game, and snapping together two interlocking puzzle pieces when the interlocking puzzle pieces are placed proximate one another in response to the play operations, wherein the snapped together puzzle pieces form a single snapped puzzle piece to solve the game; and (c) generating audio signals in concert with the play of the game, wherein the audio signals are generated for a period of time whereby a player of the game is encouraged to solve the puzzle before the audio signals stop;

wherein the step of displaying the jigsaw puzzle further comprises sequentially displaying a plurality of video image blocks by reputing steps (i)–(iii) for plurality of frames of video image information, wherein the frames of video information represent a video sequence; and wherein the step of displaying each puzzle piece further comprises the step of excluding from the video image region of the puzzle piece any portion of the video image region which overlaps the video region of another puzzle piece already displayed, whereby image flicker in overlapping puzzle pieces is eliminated.

14. The method of claim 13 wherein the step of displaying the game further comprises sequentially displaying a plurality of video image blocks by repeating steps (i)–(iii) for a plurality of frames of video image information, wherein the frames of video information represent a video sequence.

15. The method of claim 13 wherein the step of moving one or more puzzle pieces further comprises the step of moving one or more snapped puzzle pieces in response to play operations.

16. The method of claim 15 wherein the step of moving one or more puzzle pieces on the display further comprises the steps of:

(a) detecting a play operation for moving a puzzle piece at a video image region at a first location on the display;

(b) determining the displacement of movement of the puzzle piece from the first location on the display as directed by the play operation;

(c) displaying the puzzle piece in a video image region at a second location on the display offset from the first location by the displacement of movement; and (d) erasing that portion of the video image region at the first location on the display which is non-overlapping with the video image region at the second location on the display.

17. The method of claim 13 wherein steps (i)–(iii) are repeated at a rate of at least 5 per second.

18. A method of generating a game which is a jigsaw puzzle game on a display and controlling play of the game in response to play operations, the method comprising the steps of:

(a) displaying the jigsaw puzzle game on the display, the game comprising a plurality of puzzle pieces positioned on the display, and each puzzle piece comprising a video image region on the display, wherein displaying the game comprises repeating the steps of:

(i) receiving a frame of video image information;

(ii) decomposing the frame of video image information into a plurality of blocks of video image information, wherein each block of video image information corresponds to a corresponding puzzle piece, respectively; and (iii) displaying each block of video image information in the video image region of the corresponding puzzle piece; and (b) moving one or more puzzle pieces on the display in response to play operations to solve the game;

wherein the step of displaying each puzzle piece further comprises the step of excluding from the video image region of the puzzle piece any portion of the video image region which overlaps the video image region of another puzzle piece already displayed, whereby image flicker in overlapping puzzle pieces is eliminated.

19. A computer software system having a set of instructions for generating a game which is a jigsaw puzzle game on a display and controlling play of the game in response to play operations, the software system comprising:

(a) a puzzle display process for displaying the jigsaw puzzle on the display, the game comprising a plurality of puzzle pieces positioned on the display, wherein each puzzle piece comprises a video image region on the display;

(b) a sequential display process for sequentially displaying a plurality of video images blocks in the video image region of at least one puzzle piece to generate a moving video image in the video image region of the puzzle piece; and (c) a movement process for moving one or more puzzle pieces on the display in response to play operations to solve the game; and wherein the puzzle display process further comprises a set of instructions for excluding from the video image region of each puzzle piece any portion of the video image region which overlaps the video image region of another puzzle piece already displayed, whereby image flicker in overlapping puzzle pieces is eliminated.

20. The software system of claim 19 wherein the sequential display process further comprises:

(i) a process for receiving frames of video image information;

(ii) a process for decomposing each frame of video image information into a plurality of blocks of video image information, wherein each block of video image information in a frame corresponds to a corresponding puzzle piece, respectively; and (iii) a process for sequentially displaying the blocks of video image information in the video image region of the corresponding puzzle piece.

21. The software system of claim 20 wherein the receiving process comprises a set of instructions for: (i) receiving a compressed frame of video image information, and (ii) decompressing the compressed frame to generate a frame of video image information.

22. The software system of claim 19 wherein the sequential display process comprises a set of instructions for sequentially displaying a plurality of video image blocks in the video image region of each puzzle piece to generate a moving video image in the video image region of each puzzle piece.

23. The software system of claim 19 wherein the movement process comprises:

(a) a set of instructions for detecting a play operation for moving a puzzle piece at a video image region at a first location on the display;

(b) a set of instructions for determining the displacement of movement of the puzzle piece from the first location on the display as directed by the play operation;

(c) a set of instructions for displaying the puzzle piece in a video image region at a second location on the display offset from the first location by the displacement of movement; and (d) a set of instructions for erasing that portion of the video image region at the first location on the display which is non-overlapping with the video image region at the second location on the display.

24. The software system of claim 19 wherein the movement process further comprises a set of instructions for snapping together two interlocking puzzle pieces when the interlocking puzzle pieces are placed proximate one another in response to the play operations, wherein the snapped together puzzle pieces form a single snapped puzzle piece to solve the game.

25. The software system of claim 24 wherein the movement process further comprises a set of instructions for moving one or more snapped puzzle pieces in response to play operations.

26. The software system of claim 19 further comprising a sound generation process for generating audio signals in concert with the play of the game.

27. The software system of claim 26 wherein the audio signals comprise a sequence of musical tones.

28. The software system of claim 26 wherein the sound generation process comprises a set of instructions for generating the audio signals for a period of time whereby a player of the game is encouraged to solve the puzzle before the audio signals stop.

29. A computer software system having a set of instructions for generating a game which is a jigsaw puzzle game on display and controlling play of the game in response to play operations, the software system comprising:

(a) a puzzle display process for displaying the jigsaw puzzle game on the display, the game comprising a plurality of puzzle pieces positioned on the display, and each puzzle piece comprising a video image region on the display, wherein the puzzle display process comprises:

(i) a sub-process for receiving compressed frames of video image information and decompressing each compressed frame to generate a frame of video image information;

(ii) a sub-process for decomposing each frame of video image information into a plurality of blocks of video image information, wherein each block of video image information in a frame corresponds to a corresponding puzzle piece, respectively; and (iii) a sub-process for sequentially displaying the blocks of video image information in the video image region of a corresponding puzzle piece to generate a moving video image in the video image region of each puzzle piece;

(b) a movement process for moving one or more puzzle pieces on the display in response to play operations to solve the game, and snapping together two interlocking puzzle pieces when the interlocking puzzle pieces are placed proximate one another in response to the play operations, wherein the snapped together puzzle pieces form a single snapped puzzle piece to solve the game; and (c) a sound generation process for generating audio signals in concert with the play of the game, wherein the audio signals are generated for a period of time whereby a player of the game is encouraged to solve the puzzle before the audio signals stop;

wherein the puzzle display sub-processes sequentially receive, decompose, and display the frames of video information, respectively; and wherein the puzzle display process further comprises a set of instructions for excluding from the video image region of each puzzle piece any portion of the video image region which overlaps the video image region of another puzzle piece already displayed, whereby image flicker in overlapping puzzle pieces is eliminated.

30. The software system of claim 29 wherein the puzzle display sub-processes sequentially receive, decompose, and display the frames of video information, respectively.

31. The software system of claim 29 wherein the movement process further comprises a set of instructions for moving one or more snapped puzzle pieces in response to play operations.

32. The software system of claim 31 wherein the movement process comprises:

(a) a set of instructions for detecting a play operation for moving a puzzle piece at a video image region at a first location on the display;

(b) a set of instructions for determining the displacement of movement of the puzzle piece from the first location on the display as directed by the play operation;

(c) a set of instructions for displaying the puzzle piece in a video image region at a second location on the display offset from the first location by the displacement of movement; and (d) a set of instructions for erasing that portion of the video image region at the first location on the display which is non-overlapping with the video image region at the second location on the display.

33. A computer software system having a set of instructions for generating a game which is a jigsaw puzzle game on a display and controlling play of the game in response to play operations, the software system comprising:

(a) a puzzle display process for displaying the jigsaw puzzle on the display, the game comprising a plurality of puzzle pieces positioned on the display, and each puzzle piece comprising a video image region on the display, wherein the puzzle display process comprises:

(i) a sub-process for receiving frames of video image information;

(ii) a sub-process for decomposing each frame of video image information into a plurality of blocks of video image information, wherein each block of video image information in a frame corresponds to a corresponding puzzle piece, respectively; and (iii) a sub-process for sequentially displaying the blocks of video image information in the video image region of a corresponding puzzle piece to generate a moving video image in the video image region of each puzzle piece; and (b) a movement process for moving one or more puzzle pieces on the display in response to play operations to solve the game;

wherein the puzzle display process sequentially receive, decompose and display frames of video image information, respectively; and wherein the puzzle display process further comprises a sub-process for excluding from the video image region of each puzzle piece any portion of the video image region which overlaps the video image region of another puzzle piece already displayed, whereby image flicker in overlapping puzzle pieces is eliminated.

34. A system for generating a game which is a jigsaw puzzle game on a display and controlling play of the game in response to play operations, the system comprising:

(a) means for displaying the jigsaw puzzle game on the display, the game comprising a plurality of puzzle pieces positioned on the display, wherein each puzzle piece comprises a video image region on the display;

(b) means for sequentially displaying a plurality of video image blocks in the video image region of at least one puzzle piece to generate a moving video image in the video image region of the puzzle piece; and (c) means for moving one or more puzzle pieces on the display in response to play operations to solve the game; and wherein the puzzle display means further comprises means for excluding from the video image region of each puzzle piece any portion of the video image region which overlaps the video image region of another puzzle piece already displayed, whereby image flicker in overlapping puzzle pieces is eliminated.

35. The system of claim 34 wherein the sequential display means further comprises:

(i) means for receiving frames of video image information;

(ii) means for decomposing each frame of video image information into a plurality of blocks of video image information, wherein each block of video image information in a frame corresponds to a corresponding puzzle piece, respectively; and (iii) means for displaying each block of video image information in the video image region of the corresponding puzzle piece.

36. The system of claim 35 wherein the receiving means comprises means for: (i) receiving a compressed frame of video image information, and (ii) decompressing the compressed frame to generate a frame of video image information.

37. The system of claim 35 wherein the sequential display means comprises means for sequentially displaying a plurality of video image blocks in the video image region of each puzzle piece to generate a moving video image in the video image region of each puzzle piece.

38. The system of claim 34 wherein the means for moving puzzle pieces comprises:

(a) means for detecting a play operation for moving a puzzle piece at a video image region at a first location on the display;

(b) means for determining the displacement of movement of the puzzle piece from the first location on the display as directed by the play operation;

(c) means for displaying the puzzle piece in a video image region at a second location on the display offset from the first location by the displacement of movement; and (d) means for erasing that portion of the video image region at the first location on the display which is non-overlapping with the video image region at the second location on the display.

39. The system of claim 34 wherein the means for moving puzzle pieces comprises means for snapping together two interlocking puzzle pieces when the interlocking puzzle pieces are placed proximate one another in response to the play operations, wherein the snapped together puzzle pieces form a single snapped puzzle piece to solve the game.

40. The system of claim 39 wherein the means for moving puzzle piece further comprises means for moving one or more snapped puzzle pieces in response to play operations.

41. The system of claim 34 further comprising sound generation means for generating audio signals in concert with the play of the game.

42. The system of claim 41 wherein the audio signals comprise a sequence of musical tones.

43. The system of claim 41 wherein the sound generation means comprises means for generating the audio signals for a period of time whereby a player of the game is encouraged to solve the puzzle before the audio signals stop.

44. A system for generating a game which is a jigsaw puzzle game on a display and controlling play of the game in response to play operations, the system comprising:

(a) means for displaying the jigsaw puzzle game on the display, the game comprising a plurality of puzzle pieces positioned on the display, and each puzzle piece comprising a video image region on the display, the display means comprising:

(i) means for receiving compressed frames of video image information, and decompressing the compressed frame to generate a frame of video image information;

(ii) means for decomposing each frame of video image information into a plurality of blocks of video image information, wherein each block of video image information in a frame corresponds to a corresponding puzzle piece, respectively; and (iii) means for sequentially displaying the blocks of video image information in the video image region of a corresponding puzzle piece to generate a moving video image in the video image region of each puzzle piece;

(b) means for moving one or more puzzle pieces on the display in response to play operations to solve the game;

(c) means for snapping together two interlocking puzzle pieces when the interlocking puzzle pieces are placed proximate one another in response to the play operations, wherein the snapped together puzzle pieces form a single snapped puzzle piece to solve the game; and (d) sound generation means for generating audio signals in concert with the play of the game, wherein the sound generation means generates audio signals for a period of time whereby a player of the game is encouraged to solve the puzzle before the audio signals stop; and wherein the puzzle display means further comprises means for excluding from the video image region of each puzzle piece any portion of the video image region which overlaps the video image region of another puzzle piece already displayed whereby image flicker in overlapping puzzle pieces is eliminated.

45. The system of claim 44 wherein the means for moving puzzle pieces comprises:

(a) means for detecting a play operation for moving a puzzle piece at a video image region at a first location on the display;

(b) means for determining the displacement of movement of the puzzle piece from the first location on the display as directed by the play operation;

(c) means for displaying the puzzle piece in a video image region at a second location on the display offset from the first location by the displacement of movement; and (d) means for erasing that portion of the video image region at the first location on the display which is non-overlapping with the video image region at the second location on the display.

46. The system of claim 45 wherein the means for moving puzzle piece further comprises means for moving one or more snapped puzzle pieces in response to play operations.

47. A system for generating a game which is a jigsaw puzzle game on a display and controlling play of the game in response to play operations, the system comprising:

(a) means for displaying the jigsaw puzzle game on the display, the game comprising a plurality of puzzle pieces positioned on the display, and each puzzle piece comprising a video image region on the display, the display means comprising:

(i) means for receiving frames of video image information;

(ii) means for decomposing the frames of video image information into a plurality of blocks of video information, wherein each block of video image information in a frame corresponds to a corresponding puzzle piece, respectively; and (iii) means for sequentially displaying the blocks of video image information in the video image region of a corresponding puzzle piece to generate a moving video image in the video image region of each puzzle piece; and (b) means for moving one or more puzzle pieces on the display in response to play operations to solve the game; and wherein the puzzle display means further comprises means for excluding from the video image region of each puzzle piece any portion of the video image region which overlaps the video image region of another puzzle piece already displayed, whereby image flicker in overlapping puzzle pieces is eliminated.

* * * * *